US007345253B2

(12) United States Patent
Hsu

(10) Patent No.: US 7,345,253 B2
(45) Date of Patent: Mar. 18, 2008

(54) KEY STRUCTURES

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 99 days.

(21) Appl. No.: 11/489,886

(22) Filed: Jul. 19, 2006

(65) Prior Publication Data

US 2007/0028753 A1 Feb. 8, 2007

(30) Foreign Application Priority Data

Jul. 21, 2005 (TW) ..... 94124681 A

(51) Int. Cl.
*H01H 13/70* (2006.01)

(52) U.S. Cl. ..... 200/344; 200/5 A; 400/495.1

(58) Field of Classification Search ..... 200/341–345, 200/5 A; 400/490–491.2, 495, 495.1, 496; 361/680
See application file for complete search history.

(56) References Cited

U.S. PATENT DOCUMENTS 5,382,762 A * 1/1995 Mochizuki ..... 200/5 A
5,635,928 A * 6/1997 Takagi et al. ..... 400/682
6,172,868 B1 * 1/2001 Oura ..... 200/344
6,504,120 B2 * 1/2003 Hsu ..... 200/344
6,590,565 B2 * 7/2003 Hosoya ..... 345/168
7,022,927 B2 * 4/2006 Hsu ..... 200/344
7,059,789 B2 * 6/2006 Chiang ..... 400/490
7,173,200 B2 * 2/2007 Yoneyama ..... 200/5 A

FOREIGN PATENT DOCUMENTS

TW 463117 11/2001

* cited by examiner

*Primary Examiner*—Elvin Enad
*Assistant Examiner*—M. Fishman
(74) *Attorney, Agent, or Firm*—Quintero Law Office

(57) ABSTRACT

Key structures are provided. A key structure includes a key cover, a substrate, a slider movable with respect to the substrate, a first rod, a second rod and a resilient member. The first rod pivotally connects the key cover and a first guiding portion of the substrate. The second rod pivotally connects the key cover and a second guiding portion of the substrate. The resilient member connects the substrate and the first rod, and exerts a lateral force on the first rod. When the key structure is in a normal state, a first contact portion of the slider contacts and restricts the second rod. When the key structure is switched from the normal state to a depressed state, a second contact portion of the slider impels the second rod outward of the key structure, such that the key cover descends toward the substrate.

17 Claims, 6 Drawing Sheets

KEY STRUCTURES

BACKGROUND OF THE INVENTION

1. Field of the Invention

The invention relates in general to key structures and in particular to key structures switching between a normal state and a depressed state.

2. Description of the Related Art

Referring to FIGS. 1A and 1B, a conventional key structure primarily comprises a substrate B, a first rod L1, a second rod L2, a key cover C, and an elastic dome E disposed between the substrate B and the key cover C. The first rod L1 has a first end L11 and a second end L12, and the second rod L2 has a third end L23 and a fourth end L24. The first and second rods L1 and L2 are pivotally connected via a hinge H. As shown in FIGS. 1A and 1B, the first and fourth ends L11 end L24 are pivotally connected to the substrate B and key cover C. The second and third ends L12 and L23 are movable along axis X and pivotally connected to the substrate B and the key cover C.

When the key structure is depressed by an external force, from the state shown in FIG. 1A to the state shown in FIG. 1B, the key cover C descends from the height h1 to the height h2, and the elastic dome E is compressed. When the external force is released, the elastic dome E exerts a recovery force on the key cover C, such that the key cover C returns to the height h1. It can be difficult to depress the key cover C because the elastic dome E inevitably exerts an upward recovery force perpendicular to the substrate B against the external force.

BRIEF SUMMARY OF THE INVENTION

Key structures are provided. A key structure includes a key cover, a substrate, a slider movable with respect to the substrate, a first rod, a second rod and a resilient member. The first rod pivotally connects the key cover and a first guiding portion of the substrate. The second rod pivotally connects the key cover and a second guiding portion of the substrate. The resilient member connects the substrate and the first rod, and exerts a lateral force on the first rod. When the key structure is in a normal state, a first contact portion of the slider contacts and restricts the second rod. When the key structure is switched from the normal state to a depressed state, a second contact portion of the slider impels the second rod outward of the key structure, such that the key cover descends toward the substrate.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 2:
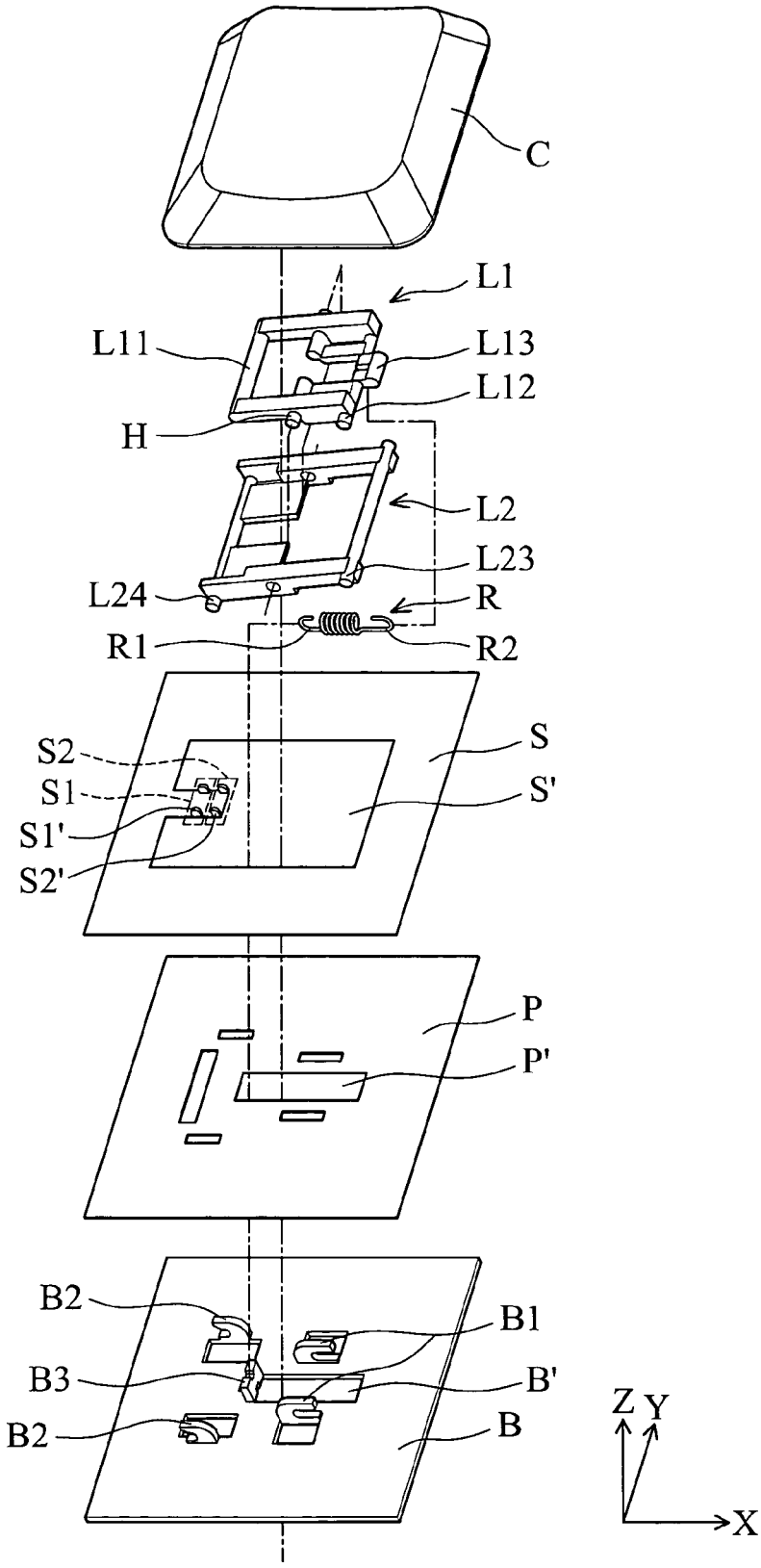
FIG. 2 is an exploded diagram of an embodiment of a key structure.

Referring to FIG. 2, an embodiment of a key structure primarily comprises a substrate B, a circuit board P, a slider S movable with respect to the substrate B, a resilient member R, a first rod L1, a second rod L2, and a key cover C. The slider S and the substrate B form a base module with the circuit board P disposed therebetween. As shown in FIG. 2, the slider S comprises a first contact portion S1 and a second contact portion S2, wherein the first contact portion S1 has a first nub S1', and the second contact portion S2 has a second nub S2'. When the slider S slides with respect to the substrate B; the key cover C descends toward the substrate B, such that the key structure is switched from a normal state to a depressed state, as shown in FIG. 4B.

Figure 3A:
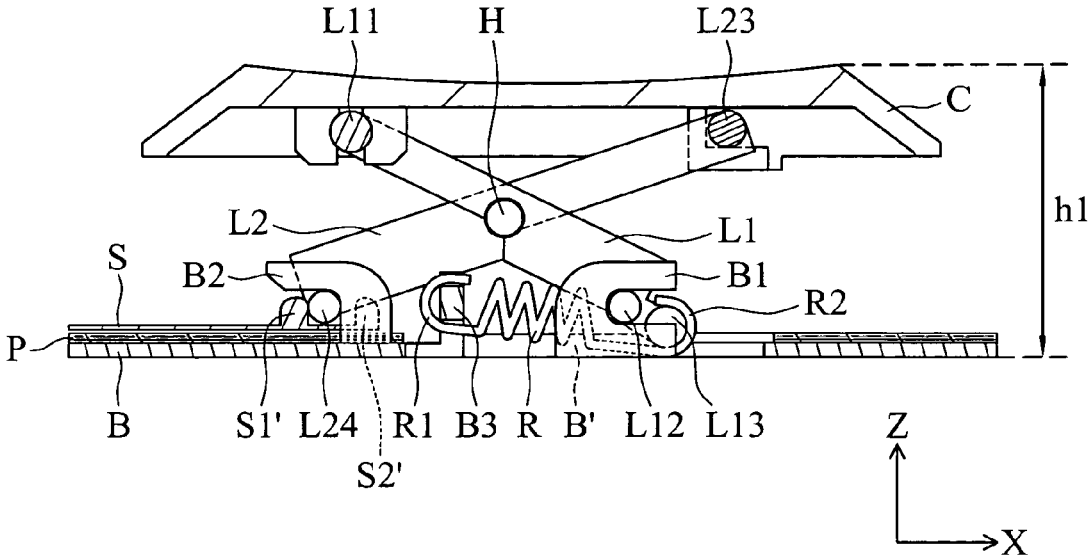
FIGS. 3A and 3B are perspective diagrams of a key structure in a normal state.

Referring to FIGS. 2 and 3A, the first and second rods L1 and L2 are pivotally connected via a hinge H and form a scissors-type support mechanism. As shown in FIG. 3A, the first rod L1 has a first end L11 and a second end L12 pivotally connected to the key cover C and the substrate B, wherein the second end L12 is slidable along a first guiding portion B1 of the substrate B. The second rod L2 has a third end L23 and a fourth end L24 pivotally connected to the key cover C and the substrate B, wherein the fourth end L24 is slidable along a second guiding portion B2 of the substrate B.

The resilient member R, such as a tension spring, has a first connection portion R1 and a second connection portion R2. The first connection portion R1 is hook-shaped and connected to a protrusion B3 of the substrate B, as shown in FIG. 3A. The second connection portion R2 is rotatably connected to a pivot portion L13 of the first rod L1. The pivot portion L13 is close to the second end L12, and the distance from the first end L11 to the pivot portion L13 exceeds that from the first end L11 to the second end L12. Referring to FIG. 3A, as the resilient member R connects the first rod L1 and the substrate B with slight extension, a lateral pre-tension spring force is exerted on the first rod L1, to hold the second end L12 at the bottom of the first guiding portion B1.

As shown in FIGS. 2 and 3A, the protrusion B3 and the first and second guiding portions B1 and B2 are disposed through the circuit board P and an opening S' of the slider S, respectively connecting the resilient member R and the first and second rods L1 and L2. Specifically, the resilient member R is disposed through the opening S' and an opening P' of the circuit board P with a part thereof accommodated in a slot B' of the substrate B, facilitating dimension reduction in Z direction.

Figure 3B:
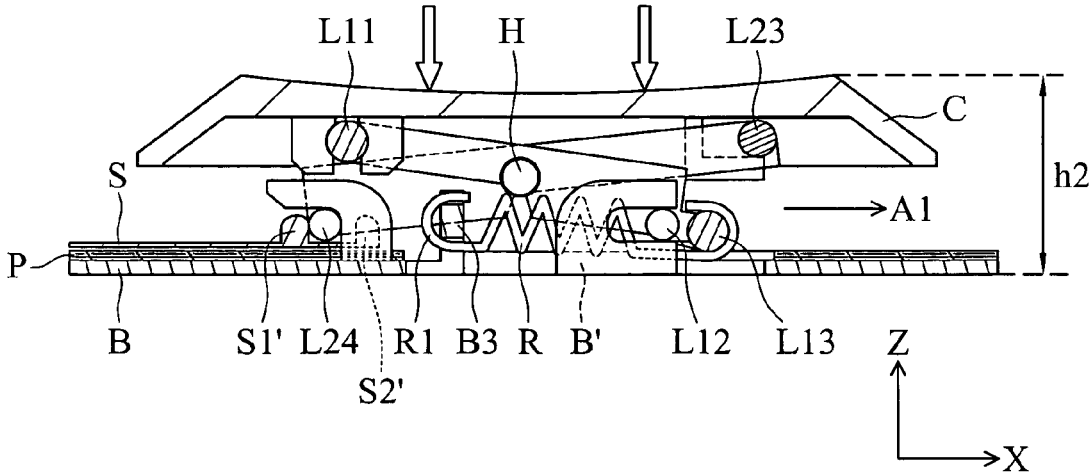

When the key structure is in a normal state, as shown in FIGS. 3A and 3B, the slider S is in a first position, and the fourth end L24 of the second rod L2 is restricted by the second guiding portion B2 and the first nub S1' from movement along axis X. Before the key cover C is depressed, the second end L12 of the first rod L1 remains at the bottom of the first guiding portion B1 by lateral spring force, such that the key cover C remains in a first height h1, as shown in FIG. 3A. The lateral spring force from the resilient member R consists of a vertical force (along axis Z) and a horizontal force (along axis X) greater than the vertical force.

When the key cover C is depressed toward the substrate B from the first height h1 to a second height h2 (shown in FIG. 3B) by an external force, the second end L12 slides in a first direction A1 along axis X. With movement of the second end L12, the resilient member R is further extended, and the second connection portion R2 of the resilient member R rotates around the pivot portion L13 and alters direction of the spring force. When the external force is released, the resilient member R provides a recovery force pulling the first rod L1 to the left, such that the key cover C returns to the first height h1.

Figure 4A:
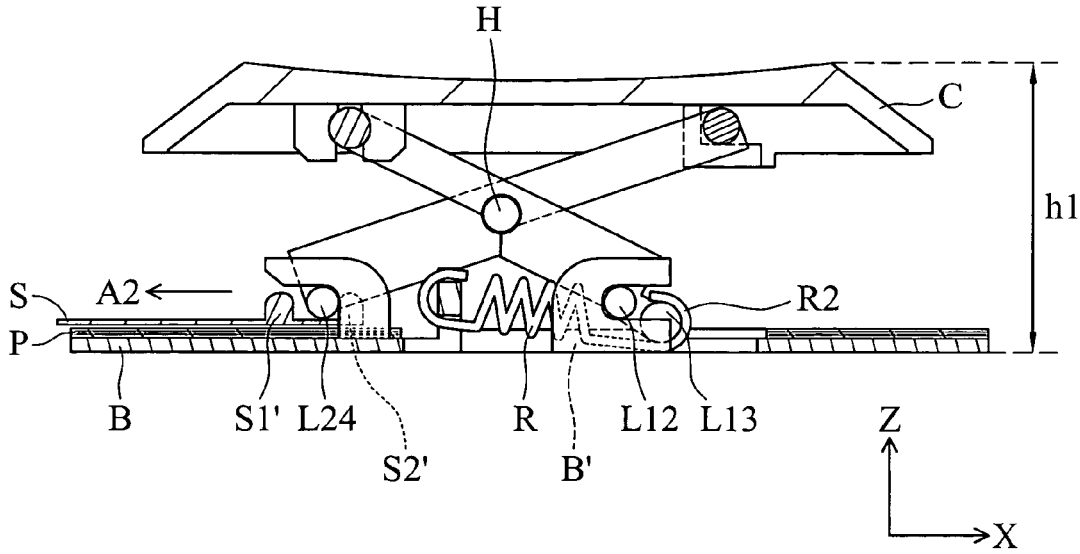
FIGS. 4A and 4B are perspective diagrams of a key structure switched to a depressed state.
Figure 4B:
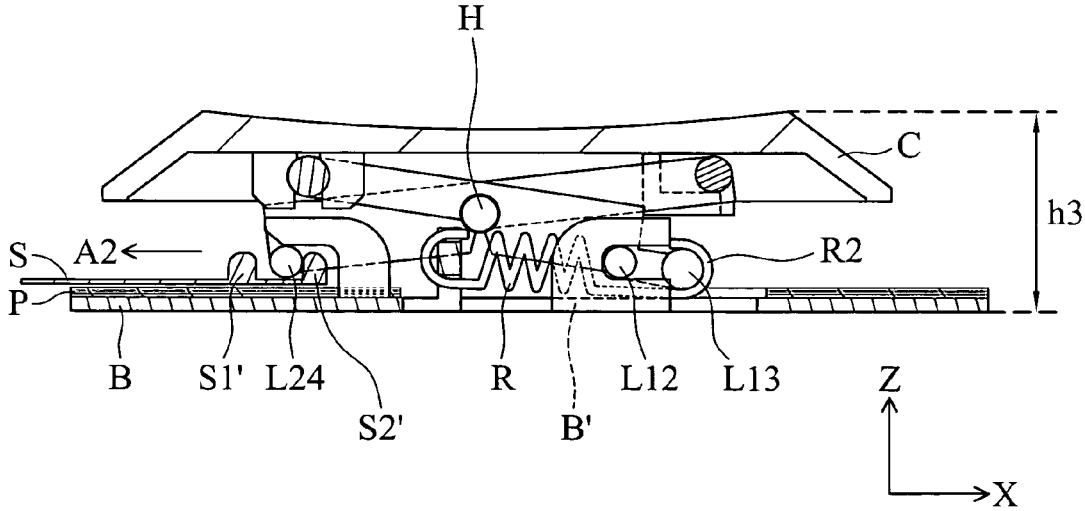

Referring to FIGS. 4A and 4B, when the slider S moves horizontally along a second direction A2 from the first position (shown in FIGS. 3A and 3B) to a second position, the key structure is switched from the normal state to a depressed state. During movement of the slider S, a second nub S2' of the second contact portion S2 contacts and impels the fourth end L24 of the second rod L2 to the left, as shown in FIGS. 4A and 4B, such that the key cover C descends from the first height h1 to a third height h3, wherein the second end L12 remains at the bottom of the first guiding portion B1, and no further extension is applied to the resilient member R.

Figure 1A:
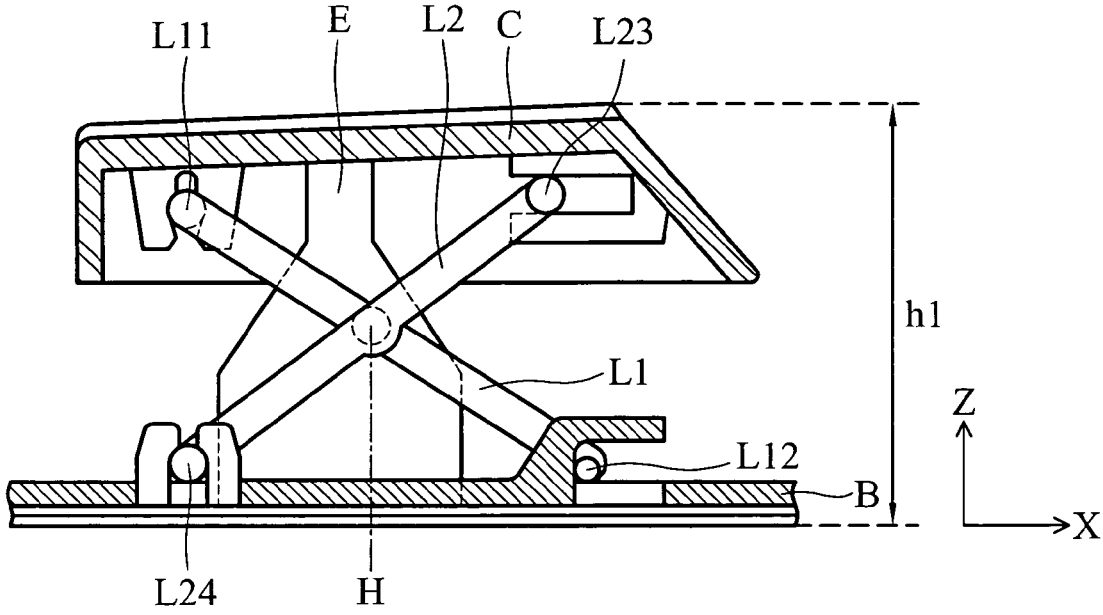
FIG. 1A ( RELATED ART )
FIGS. 1A and 1B are perspective diagrams of a conventional key structure.
Figure 1B:
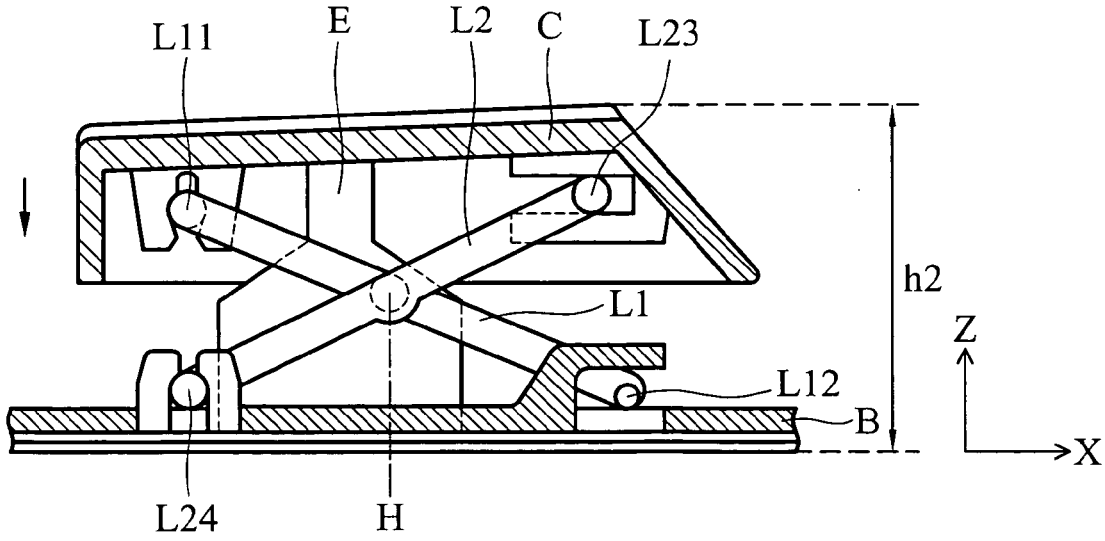
FIG. 1B ( RELATED ART )

Compared with conventional key structure employing the elastic dome E as shown in FIGS. 1A and 1B, the key structure of this embodiment can easily be switched between the normal and depressed states because of the lateral spring force exerted on the first rod L1. When the key structure is in the normal state, the fourth end L24 is restricted by the first nub S1' and the second guiding portion S2 from movement along axis X. When the key structure is switched from the normal state to the depressed state as shown in FIG. 4B, the fourth end L24 is impelled by the second nub S2' to the left. Since no further extension is applied to the resilient member R during movement of the slider S, operation of the key structure is easier and life time of the resilient member R is potentially increased.

Figure 5:
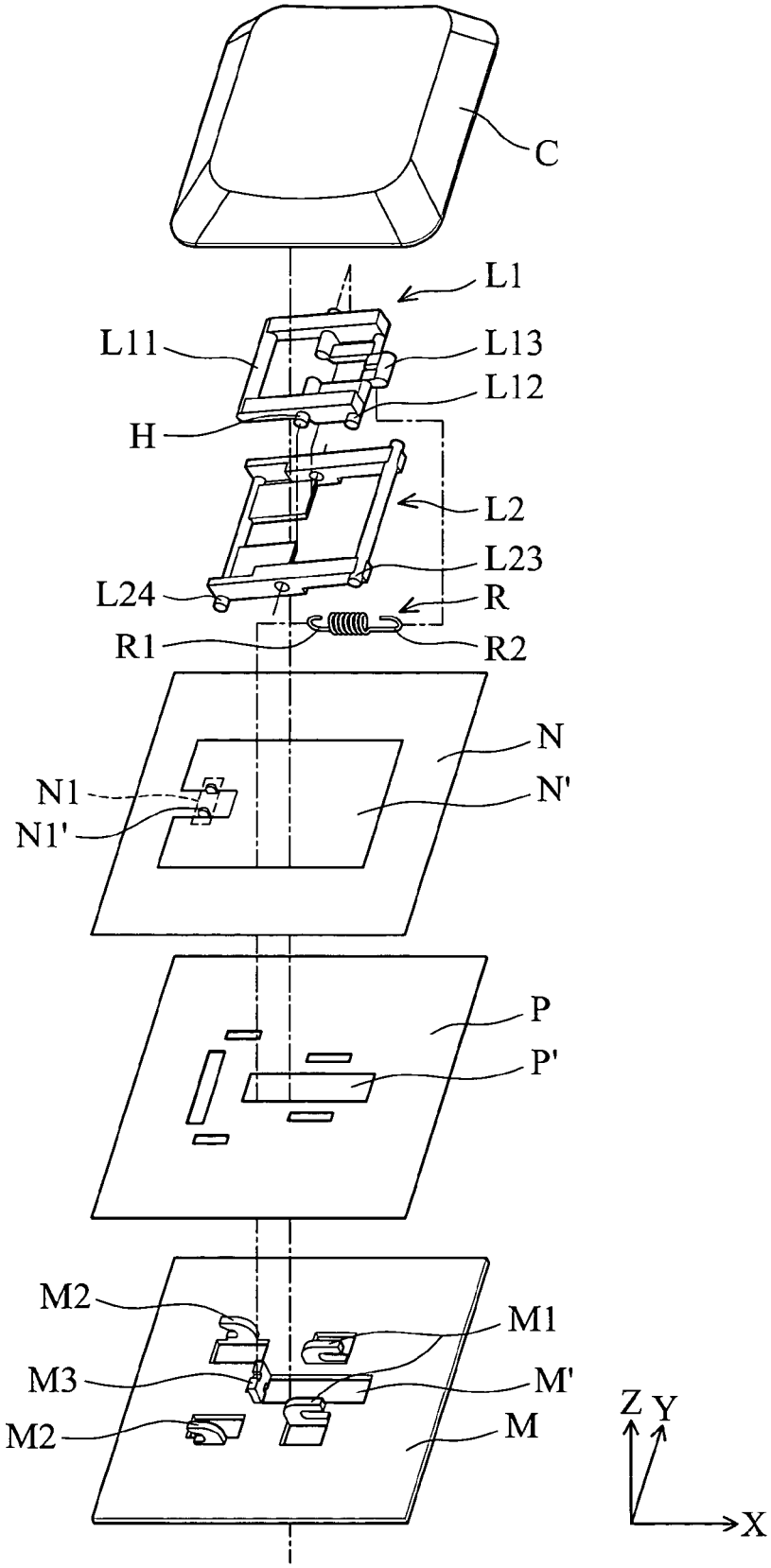
FIG. 5 is an exploded diagram of another embodiment of a key structure.

Referring to FIG. 5, another embodiment of a key structure is used in a normal state, primarily comprising a first substrate M, a second substrate N, a circuit board P, a resilient member R, a first rod L1, a second rod L2, and a key cover C. The first and second substrates M and N are fixed, forming a base module with the circuit board P disposed therebetween. As shown in FIG. 5, the first substrate M comprises a first guiding portion M1, a second guiding portion M2, and a protrusion M3. The second substrate N comprises a first contact portion N1 having a first nub N1'.

Figure 6A:
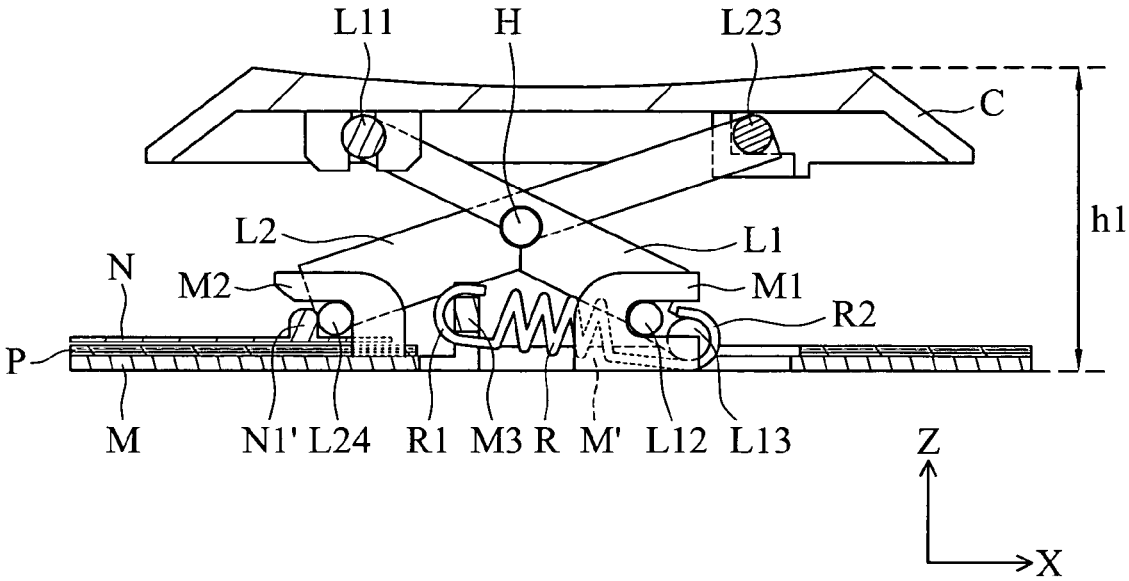
FIGS. 6A and 6B are perspective diagrams of a key structure in a normal state.
Figure 6B:
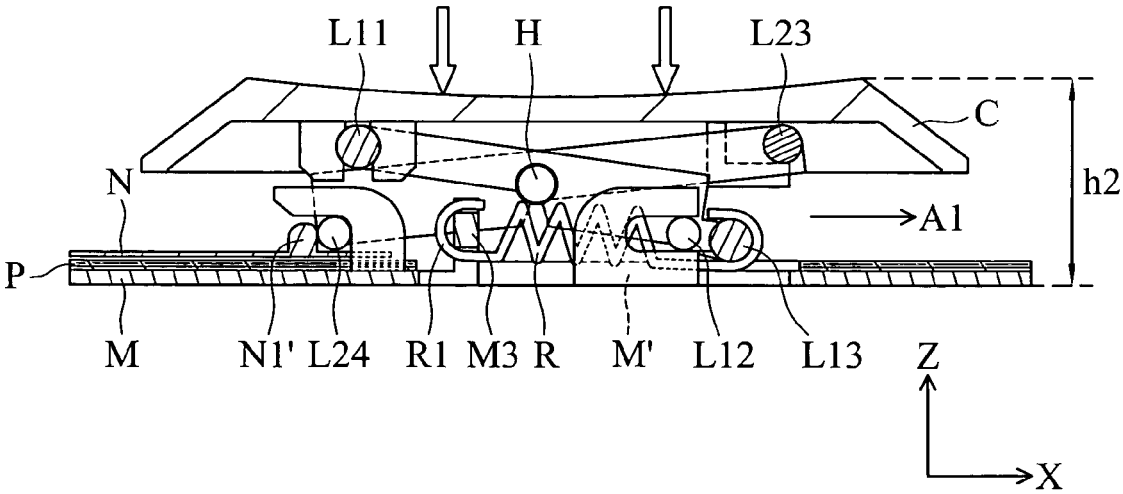

The resilient member R, such as a tension spring or extendable resilient member, has a first connection portion R1 and a second connection portion R2. As shown in FIGS. 5, 6A and 6B, the first connection portion R1 is hook-shaped and connected to the protrusion M3 of the substrate M. The second connection portion R2 is rotatably connected to a pivot portion L13 of the first rod L1, close to the second end L12, wherein the distance from the first end L11 to the pivot portion L13 exceeds that from the first end L11 to the second end L12.

During assembly of the key structure, as shown in FIGS. 5 and 6A, the protrusion M3 and the first and second guiding portions M1 and M2 are disposed through the circuit board P and an opening N' of the second substrate N, respectively connecting the resilient member R and the first and second rods L1 and L2. Specifically, the resilient member R is disposed through the opening N' and an opening P' of the circuit board P with a part thereof accommodated in a slot M' of the substrate M, facilitating dimension reduction in Z direction.

Referring to FIG. 6A, before the key cover C is depressed, the resilient member R connects the first rod L1 and the substrate M with slight extension, and a lateral pre-tension spring force is exerted on the first rod L1, to hold the second end L12 at the bottom of the first guiding portion M1, such that the key cover C remains at a first height h1. The lateral spring force from the resilient member R consists of a vertical force (along axis Z) and a horizontal force (along axis X) exceeding the vertical force.

When the key cover C is depressed toward the first substrate M from the first height h1 to a second height h2 (shown in FIG. 6B) by an external force, the second end L12 slides in a first direction A1 (along axis X). With movement of the second end L12, the resilient member R is further extended, wherein the second connection portion R2 of the resilient member R rotates around the pivot portion L13 and alters direction of the spring force. When the external force is released, the resilient member R provides a recovery force pulling the first rod L1 to the left, such that the key cover C returns to the first height h1. In some embodiments, the first contact portion N1, the protrusion M3, and the first and second guiding portions M1 and M2 can be alternatively disposed on the first substrate M or the second substrate N.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A key structure, comprising:

a key cover;

a base module, comprising:

a substrate, comprising a first guiding portion and a second guiding portion;

a slider, movable between a first position and a second position, comprising a first contact portion and a second contact portion;

a first rod, comprising a first end pivotally connected to the key cover and a second end pivotally connected to the first guiding portion, wherein the second end is movable along the first guiding portion;

a second rod, connected to the first rod, comprising a third end pivotally connected to the key cover and a fourth end pivotally connecting the second guiding portion, wherein the fourth end is movable along the second guiding portion; and a resilient member, connecting the substrate and the first rod and exerting a lateral spring force on the first rod, wherein when the key structure is in a normal state, the first contact portion restricts the fourth end, and the key cover is perpendicularly movable with respect to the substrate;

wherein when slider moves from the first position to the second position, the second contact portion impels the fourth end of the second rod outward of the key structure, such that the key cover descends toward the substrate, and the key structure is switched from the normal state to a depressed state.

2. The key structure as claimed in claim 1, wherein the resilient member comprises a tension spring.

3. The key structure as claimed in claim 1, wherein the first rod further comprises a pivot portion close to the second end, and the resilient member comprises a first connection portion connected to the substrate and a second connection portion rotatably connected to the pivot portion.

4. The key structure as claimed in claim 2, wherein the first connection portion is hook-shaped, and the substrate comprises a protrusion connected to the first connection portion of the resilient member.

5. The key structure as claimed in claim 2, wherein when the key cover is pressed toward the substrate in the normal state, the second end slides in a first direction along the first guiding portion, and the resilient member rotates around the pivot portion and alters direction of the lateral spring force.

6. The key structure as claimed in claim 1, wherein the substrate further comprises a slot with at least a part of the resilient member accommodated therein.

7. The key structure as claimed in claim 6, further comprising a circuit board disposed between the key cover and the substrate, wherein the circuit board comprises an opening with the resilient member passing therethrough, corresponding to the slot.

8. The key structure as claimed in claim 1, wherein the lateral spring force consists of a vertical force and a horizontal force exceeding the vertical force.

9. The key structure as claimed in claim 1, wherein the first contact portion comprises a first nub, the second contact portion comprises a second nub, and the fourth end is restricted between the first and second nubs.

10. A key structure, comprising:

a key cover;

a base module, comprising:

a substrate, comprising a first guiding portion, a second guiding portion and a first contact portion;

a first rod, comprising a first end pivotally connected to the key cover and a second end pivotally connected to the first guiding portion, wherein the second end is movable along the first guiding portion;

a second rod, connected to the first rod, comprising a third end pivotally connecting the key cover and a fourth end pivotally connecting the second guiding portion, wherein the fourth end is movable along the second guiding portion; and a resilient member, connecting the base module and the first rod and exerting a lateral spring force on the first rod, wherein when the key cover is depressed by an external force from a first height, the second rod slides in a first direction along the first guiding portion, and the first contact portion contacts and restricts the fourth end from movement, such that the key cover descends toward the base module;

wherein when the external force is released, the lateral spring force impels the second end in a second direction, opposite to the first direction, such that the key cover returns to the first height.

11. The key structure as claimed in claim 10, wherein the base module comprises a first substrate and a second substrate fixed to the first substrate, the first and second guiding portions are disposed on the first substrate, and the first contact portion is disposed on the second substrate.

12. The key structure as claimed in claim 10, wherein the resilient member comprises a tension spring.

13. The key structure as claimed in claim 10, wherein the first rod further comprises a pivot portion close to the second end, and the resilient member comprises a first connection portion connected to the substrate and a second connection portion rotatably connected to the pivot portion.

14. The key structure as claimed in claim 10, wherein the base module further comprises a slot with at least a part of the resilient member accommodated therein.

15. The key structure as claimed in claim 14, further comprising a circuit board disposed between the key cover and the base module, wherein the circuit board comprises an opening with the resilient member passing therethrough, corresponding to the slot.

16. The key structure as claimed in claim 10, wherein the lateral spring force consists of a vertical force and a horizontal exceeding the vertical force.

17. The key structure as claimed in claim 10, wherein the distance from the first end to the pivot portion exceeds that from the first end to the second end.

* * * * *